United States Patent [19]

Alwine

[11] Patent Number: 4,846,731

[45] Date of Patent: Jul. 11, 1989

[54] SHIELDED ELECTRICAL CONNECTORS

[75] Inventor: Kenneth T. Alwine, Dover, Pa.

[73] Assignee: AMP Incorporated, Harrisburg, Pa.

[21] Appl. No.: 227,285

[22] Filed: Aug. 3, 1988

[51] Int. Cl.[4] ..... H01R 25/00

[52] U.S. Cl. ..... 439/651; 439/675; 439/642

[58] Field of Search ..... 439/578–585, 439/675, 387, 433, 434, 444, 641, 642, 644, 645, 648, 649, 271, 651

[56] References Cited

U.S. PATENT DOCUMENTS

| | | | |
|---|---|---|---|
| 3,292,117 | 12/1966 | Bryant et al. | 439/578 |
| 3,321,732 | 5/1967 | Forney, Jr. | 339/177 |
| 3,372,364 | 3/1968 | O'Keefe et al. | 339/177 |
| 3,437,982 | 4/1969 | O'Keefe et al. | 439/578 |
| 3,445,794 | 5/1969 | O'Keefe et al. | 339/177 |
| 3,460,072 | 8/1969 | Ziegler, Jr. | 339/177 |
| 4,206,963 | 6/1980 | English et al. | 339/147 R |
| 4,360,245 | 11/1982 | Nikitas | 439/578 |
| 4,445,744 | 5/1984 | Sedig et al. | 439/271 |
| 4,556,271 | 12/1985 | Hubbard | 439/271 |
| 4,592,616 | 6/1986 | Drew et al. | 439/578 |
| 4,619,496 | 10/1986 | Forney, Jr. et al. | 439/585 |
| 4,687,279 | 8/1987 | Holland et al. | 439/578 |

OTHER PUBLICATIONS

AMP Guide to RF Connectors–Catalog 80–570, Issued 7–82, pp. 258 & 259.

SMA Coaxial Connectors–Catalog 82–689, revised 9–86, pp. 9 & 10.

Instruction Sheet IS2189, AMP Incorporated, released 8–23–67, revised 7–19–71, pp. 1 & 2.

*Primary Examiner*—David Pirlot

[57] ABSTRACT

A circular cross section, shielded electrical connector adaptor (8) comprises a metal shell (54), in which is fitted frictionally, a dielectric plug (70) having a central bore (72) in which an elongate rectilinear electrical contact element (82) is fitted frictionally. The shell (54) has at each end thereof a peripheral, external screwthread (56,58). The contact element (82) has a pin portion (86) at one end and a receptacle portion (90) at its other end. The screwthreads (56 and 58) can be meshed with internal screwthreads (28 and 40) of a shielded plug connector part (4) and a shielded jack connector part (6) to provide a double ended, shielded electrical connector (2) having a plug at one end and a jack at the other end. The contact element may be provided with pin portions (86) or receptacle portions (90) at both ends, for producing a connector with a plug at both ends or a jack at both ends, respectively.

17 Claims, 2 Drawing Sheets

SHIELDED ELECTRICAL CONNECTORS

FIELD OF THE INVENTION

This invention relates to shielded electrical connectors and in particular to adaptors for use in providing them.

BACKGROUND OF THE INVENTION

In test laboratories plug and jack shielded BNC and TNC connectors may need to be provided in back to back relationship, in the form of plug to jack connectors, plug to plug connectors and jack to jack connectors. Shielded plug connectors comprise an externally metal shielded dielectric having a central bore, in which is a contact element having a mating portion in the form of male electrical terminal, usually a pin terminal, which will usually project into a skirt defined by the dielectric. In shielded jack connectors, the mating portion is in the form of a female electrical terminal, usually a receptacle terminal for mating with a pin terminal, and which usually lies in a plug portion defined by the dielectric.

SUMMARY OF THE INVENTION

Broadly stated, the invention provides a shielded adaptor comprising a tubular metal shell in which a dielectric plug is frictionally secured, the plug defining a central, through bore in which is frictionally secured an elongate electrical contact element comprising a shaft having at each end, a mating portion, which may be in the form of either a male or a female electrical terminal. The shaft projects in opposite directions from the metal shell and the dielectric plug so that each mating portion is positioned remotely therefrom. The tubular metal shell is formed at each end thereof with an external circumferential, screw thread for meshing with an internal peripheral screw thread formed in one end of the shielding of a shielded dielectric of a shielded plug or jack connector part, the dielectric having a through, central bore. In dependence upon the gender of said mating portions, each end of contact element is inserted through the bore of a plug connector part or of a jack connector part, and the screw threads of the adaptor and of said connector parts are intermeshed and screwed home so that the mating portions of the contact element are correctly positioned in the dielectrics, whereby a double end shielded electrical connector is provided comprising a plug and a jack, or two plugs or two jacks arranged in back to back relationship.

Thus kits of parts each comprising a plug to jack, a plug to plug and a jack to jack, adaptor and a series of plug connector parts and jack connector parts can be supplied to the customer so that the customer can assemble desired combinations of double ended, shielded, plug and jack, plug and plug or jack and jack connectors.

The dielectric plug of the adaptor may be retained in the metal shell thereof by means of longitudinal internal ribs in the shell, which bite into the material of the dielectric plug, the ribs may be of rectangular cross section to present sharp edges directed inwardly of the shield. The ribs may be formed on the internal surface of an internal collar of shell, which receives a reduced cross section nose of the dielectric plug, the remainder of the dielectric plug fitting snugly in the shell.

The contact element may be frictionally retained in the shell by means of a knurled central portion of the shaft of the contact element, force fitted into said bore.

The shells and the dielectric plugs of the three versions of the adaptor are preferably identical for the alleviation of stocking problems and the contact elements can be identical excepting for their mating portions. In some cases, the customer may wish to be supplied with the adaptor parts so that he can assemble them to his own requirements.

BRIEF DESCRIPTION OF THE DRAWINGS

For a better understanding of the invention, reference will now be made by way of example to the accompanying drawings in which.

DETAILED DESCRIPTION OF THE INVENTION

Figure 1:
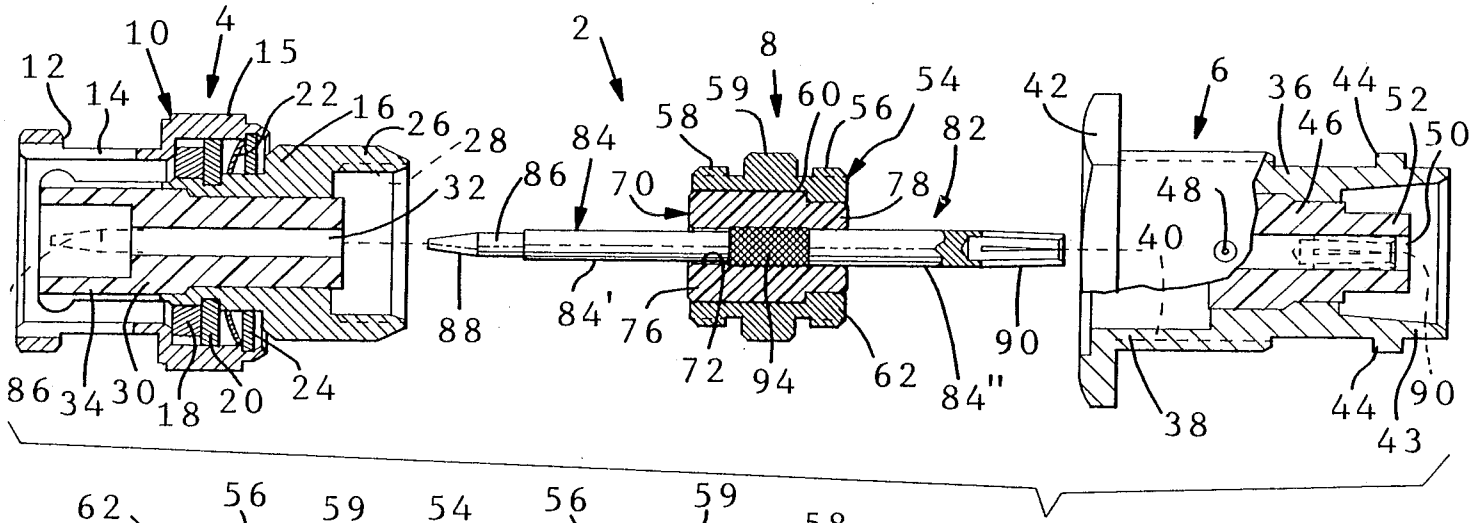
FIG. 1 is an exploded view shown mainly in longitudinal section, of a double ended, shielded, electrical connector, comprising a plug part, a jack part, and an adaptor.

A double ended, shielded, electrical connector shown in FIG. 1 and generally referenced 2, comprises a circular cross section, shielded plug part 4, a circular cross section, shielded jack part 6, and a circular cross section, shielded adaptor 8.

The plug part 4 comprises a metal collar 10 having a forwardly projecting skirt 12 formed with a circumferentially obliquely extending slot 14 to provide a bayonet joint in cooperation with a mating connector part (not shown), for example a jack similar to the jack part 6. The collar has a radially projecting, peripheral, external, finger grip surface 15, which is preferably knurled. The collar 10 is mounted for rotation relative to a metal body 16 with the interposition therebetween of a resilient gasket 18, a collapsible washer 20, a cup spring 22 and a washer 24 whereby the collar 10 and the body 6 are relatively axially slidable to a limited extent against the resilient action of the gasket and the spring. The body 16 has a rearwardly projecting hood 26 having an internal circumferential screw thread 28 and has secured therein a dielectric 30 having an internal, through bore 32 which communicates at one end with the interior of the hood 26 and at its other end with the interior of a skirt 34 defined by the dielectric 30, for receiving an insulating male portion containing an electrical receptacle, of said mating connector part. The bore 32 is coaxial with said metal parts, which constitute the shielding of the connector part 4.

The jack part 6 comprises shielding in the form of an outer metal shell 36 defining at its rear end a hood 38 formed with an internal circumferential screw thread 40 and with an external, peripheral, hexagonal nut 42. At its forward end, the shell 36 defines a skirt 43 having a pair of opposed, external studs 44 projecting therefrom between its ends, for reception in the slots of a bayonet joint element of a mating electrical connector part (not shown), similar for example, to the plug part 4. There is secured within the shell 36, by means of a detent 48, a dielectric 46, having a through bore 50 coaxial with the shell 36 and communicating at one end with the interior of the hood 38 and at its other end with the interior of the skirt 43. The dielectric 46 has a reduced cross section, forwardly projecting, plug portion 52 for reception in a complementary hood of the dielectric of said mating connector part, into which hood projects a male contact element.

Figure 6:
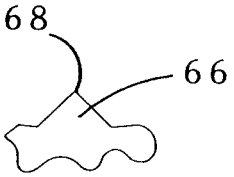
FIG. 6 is a fragmentary elevational view illustrating the profile of an internal retaining rib of the shell shown in FIGS. 2 and 3.
Figure 2:
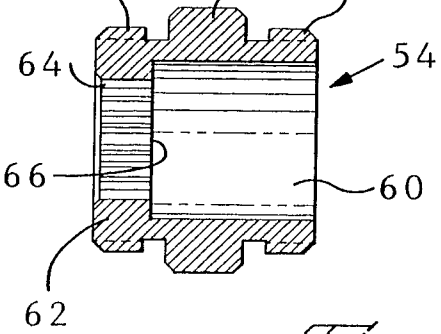
FIG. 2 is an axial sectional view of a metal shell of the adaptor.
Figure 3:
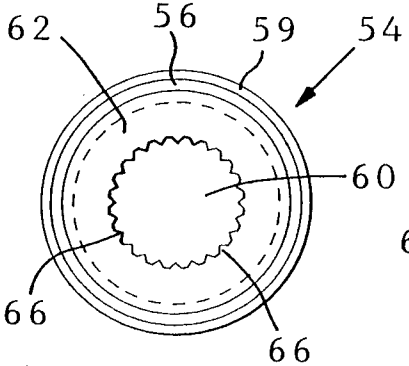
FIG. 3 is an end view of FIG. 2.

The adaptor 8 comprises shielding in the form of a tubular metal shell 54 having at each end thereof an external circumferential screw thread, 56 and 58, respectively, each dimensioned to match either with the screw thread 28 or the screw thread 38. The threads 56 and 58 are thus identical but are arranged in rotational symmetry. Midway between the screw threads 56 and 58, the shell 54 has an external, circumferential, finger grip collar 59 which is preferably knurled. The shell 54 defines a central, circular cross section, through opening 60 into which projects an internal collar 62 of the shell 54, the collar 62 having, as shown in the FIGS. 2, 3 and 6, an internal surface 64 formed with a series of parallel, ribs 66 each extending axially of the shell 54 and about the entire internal circumference of the collar 64. As best seen in FIG. 6, each rib 66 is of rectangular cross section and has a sharp edge in the form of an apex 68 directed radially inwardly of the collar 62. A circular cross section dielectric plug 70 defining a circular bore 72 coaxial with the shell 54, of constant cross sectional area but having slightly enlarged mouth 74, best seen in FIG. 5, has a larger cross section portion 76 dimensioned to fit snugly into the opening 60 and a smaller cross section nose 78 which is frictionally received in the collar 62. The apices 68 of the ribs 66 bite into the external surface 80 of the nose 78 to ensure that the dielectric plug 70 can withstand a push out force relative to the shell 54, which is substantial, being for example a force of 4 lbs, and to ensure that the plug 70 has a substantial resistance to rotation relative to the shell 58 of 4 inch—ounce. A circular cross section, rectilinear, elongate, electrical contact element 82 of the adaptor 8, comprises a shaft 84 formed at one end with a male mating portion in the form of an electrical pin terminal 86 having a tapered lead in end 88, and at its opposite end, with a female mating portion 90 formed with longitudinal slots 92 defining resilient, longitudinally extending contact springs to provide an electrical receptacle terminal for mating with a pin terminal such as the pin terminal 86. Longitudinally centrally thereof, the shaft 84 is formed with a slightly enlarged cross section, knurled retention portion 94 which is frictionally received in the bore 72 of the dielectric plug 70, so that the torque and pullout resistances of the contact element 82 with respect to the plug 70 are not less than those of the plug 70 with respect to the shell 54.

In order to assembly the connector 2, the screw threads 58 and 56 are meshed with the screw threads 28 and 38, respectively, of the plug part 4 and the jack part 6 and are screwed home with the aid of the surface 15, the collar 59 and the nut 42, so that portions 84' and 84'', respectively, of the shaft 84, which portions project to a substantial distance beyond the shell 54 and the dielectric plug 70 are received in the respective bores 32 and 50 of the dielectrics 30 and 46, the mating portion 86 projecting into the skirt 34 of the dielectric 30 and the mating portion 90 lying within the plug portion 52 of the dielectric 46, as indicated in broken lines in FIG. 1. Thus said mating connectors can be mated with the plug parts 4 and 6 to provide a continuous, shielded electrical connection between the contact elements of the said mating connectors. Similarly, a series of connectors 2 could be mated with one another to provide a shielded line of any desired length.

As will be appreciated from the above description, when the connector 2 has been assembled as described above, the plug part 4 constitutes a shielded electrical plug, the jack part 6 constituting a shielded electrical jack.

The adaptor 8 can be assembled so as to provide a connector having two jacks or two plugs, arranged in back to back relationship.

Figures 4, 5, 7, 8:
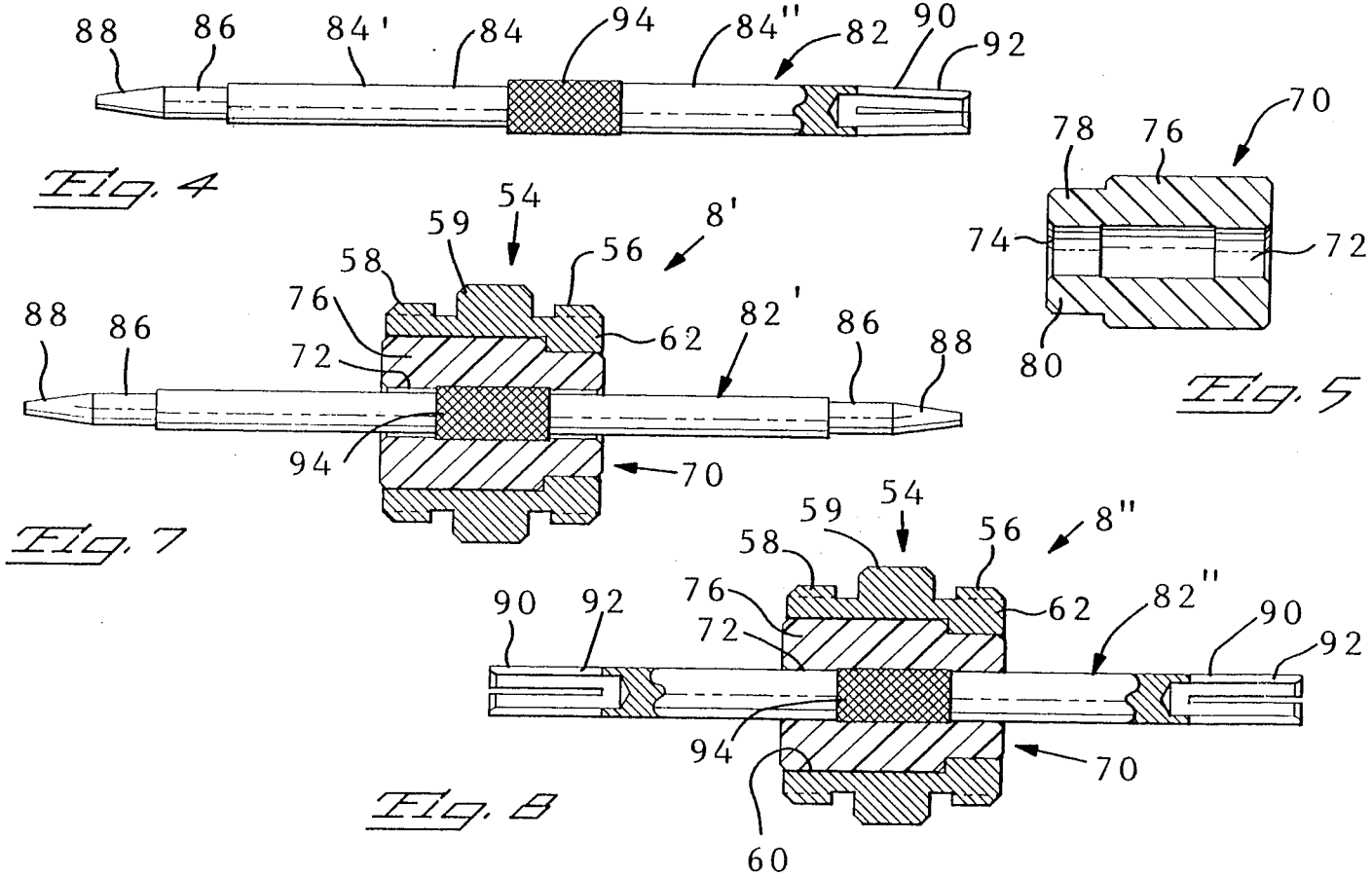
FIG. 4 is an elevational view, shown partly in section, of an electrical contact element of the adaptor.
FIG. 5 is an axial sectional view, drawn to a smaller scale than FIGS. 2 and 3, of a dielectric plug of the adaptor.
FIG. 7 is a longitudinal sectional view of the adaptor, drawn to a larger scale than FIG. 1, when assembled for use with two plug parts instead of with a plug part and a jack part.
FIG. 8 is a similar view to that of FIG. 7 but showing the adaptor when assembled for use with two jacks parts.

The adaptor 8' shown in FIG. 7 has been assembled with a plug to plug contact element 82' having at each end, a male mating part 86. The adaptor 8' can be assembled to two plug parts 4 to provide a double ended, shielded plug connector. The adaptor 8'' shown in FIG. 8 is identical with the adaptors 8 and 8', excepting that it is assembled with a contact element 82'', having at each end a female mating part 90 so that the adaptor 8'' can be assembled to two jack parts 6 to provide a shielded, double ended jack connector.

Especially, for test laboratory use, where the customer will need to have at his disposal, the ability to adapt the interface within, or between, BNC or TNC, he can be supplied with sets of three adaptors 8, 8' and 8'', respectively, together with the necessary number of plug and jack parts and their mating connectors. It is to be noted, that in the interests of economy, the shells 54, and the dielectric plugs 70 of all three adaptors are identical, the contact elements 82, 82' and 82'' of these adaptors also being identical excepting for their mating parts 86 and 90. Each adaptor can very easily be assembled simply by fitting the appropriate contact element into the opening 72 of the dielectric plug 70 inserting the nose 76 thereof into the collar 62 of the shell 54, with the necessary force, which will be quite substantial, in view of the pull out and torque resistance requirements recited above. The customer may however, be provided with shell 54, dielectric 70 and contact elements 82, 82' and 82'' to assemble as he pleases instead of with ready assembled adaptors.

I claim:

1. An adaptor for use in providing a double-ended shielded, electrical connector in which first and second connector parts, secured together in back to back relationship, each comprises a dielectric externally shielded by shielding and having a central bore therethrough, and a common elongate electrical contact element received in the bores of both of said dielectrics and having a mating portion at each end thereof, the adaptor comprising;

a tubular metal shell having a central through opening, and having formed thereon an external screwthread surrounding each end of the opening for meshing with a complementary internal screwthread formed in the shielding of a respective one of said connector parts; and a dielectric plug frictionally engaged in said opening and having a central bore therethrough having a bore wall, said common electrical contact element extending through said central bore and having means for securing it therein in firm frictional ly engagement with said bore wall, said contact element projecting from opposite sides of said adaptor with the mating portions of the contact element positioned remotely from said shielding and said plug for insertion into the respective bores of said dielectrics of said connector parts, as said screwthreads are meshed with each other and are screwed home, said shell has, proximate to one end thereof, an internal collar having a circumferential surface projecting into the central through opening of the shell and being formed with longitudinal ribs having sharp edges pointing radially inwardly of said opening, said dielectric having a larger cross section portion snugly received in said through opening, and a reduced cross section nose for frictional engagement with said ribs.

2. An adaptor as claimed in claim 1, wherein one of said mating portions is in the form of a receptacle for mating with an electrical pin, the other mating portion being in the form of an electrical pin for mating with an electrical receptacle.

3. An adaptor as claim in claim 1, wherein said mating portions are identical.

4. An adaptor as claimed in claim 1, wherein said shielding has internal, axially extending, ribs frictionally engaging said dielectric sleeve.

5. An adaptor as claimed in claim 1, wherein said contact element comprises an externally knurled, longitudinally central portion thereof fitted into the bore of said dielectric plug and frictionally engaging said bore wall thereof.

6. An electrical connector comprising;

first and second circular cross section electrical connector parts, each having an outer metal shield with a dielectric secured therein and having a through bore which is coaxial with said shield, the shell being formed with a hood projecting from one end thereof and having an internal screw thread therein; and an adaptor comprising, an outer tubular metal shell formed at each end with an external screw thread meshing with a screw thread of a respective one of said connector parts, a dielectric sleeve frictionally secured in the shell in coaxial relationship therewith, a rectilinear electrical contact element frictionally retained in the bore of said sleeve, a shaft of said contact element projecting in opposite directions from said sleeve and said shell, and into the bore of the dielectric of each of said connector parts, and terminating in a mating portion positioned therein to mate with a mating electrical contact member inserted into said connector part from the other end thereof, said first electrical connector part constitutes, in combination with said adapter, an electrical plug, the dielectric of said first connector part defining a skirt at an end thereof opposite to said hood, one mating portion of said contact element being in the form of an electrical pin projecting into said skirt for mating with an electrical receptacle inserted thereinto, the second electrical connector part constituting, in combination with said adaptor, an electrical jack, the dielectric of said second connector part being formed with a plug portion at an end remote from the hood of said second electrical connector part, the bore of that dielectric opening onto an end of said plug portion, the other mating portion of said contact element being received in the form of an electrical receptacle and being received in said plug portion for mating with an electrical pin inserted thereinto.

7. A connector as claimed in claim 6, wherein said external screw threads are identical but are arranged in rotational symmetry.

8. A connector as claimed in claim 6, wherein said shell is provided with a circumferential, finger grip collar arranged between said external screw threads and projecting radially outwardly there beyond.

9. A connector as claimed in claim 6, wherein said dielectric sleeve is in the form of a plug having a reduced cross section nose, said shield of the adaptor having an internally ribbed collar receiving said nose.

10. An electrical connector comprising;

first and second circular cross section electrical connector parts, each having an outer metal shield with a dielectric secured therein and having a through bore which is coaxial with said shield, the shell being formed with a hood projecting from one end thereof and having an internal screw thread therein; and an adaptor comprising, an outer tubular metal shell formed at each end with an external screw thread meshing with a screw thread of a respective one of said connector parts, a dielectric sleeve frictionally secured in the shell in coaxial relationship therewith, a rectilinear electrical contact element frictionally retained in the bore of said sleeve, a shaft of said contact element projecting in opposite directions from said sleeve and said shell, and into the bore of the dielectric of each of said connector parts, and terminating in a mating portion positioned therein to mate with a mating electrical contact member inserted into said connector part from the other end thereof, each of said first and second electrical connector parts constitutes, in combination with the adaptor, an electrical plug, the dielectric of each of said parts defining a skirt at its end remote from the hood of said part, each contact portion of said contact element being in the form of an electrical pin projecting into the skirt of the respective dielectric for mating with an electrical receptacle inserted into said skirt.

11. A connector as claimed in claim 10, wherein said external screw threads are identical but are arranged in rotational symmetry.

12. A connector as claimed in claim 10, wherein said shell is provided with a circumferential, finger grip collar arranged between said external screw threads and projecting radially outwardly therebeyond.

13. A connector as claimed in claim 10, wherein said dielectric sleeve is in the form of a plug having a reduced cross section nose, said shield of the adaptor having an internally ribbed collar receiving said nose.

14. An electrical connector comprising;

first and second circular cross section electrical connector parts, each having an outer metal shield with a dielectric secured therein and having a through bore which is coaxial with said shield, the shell being formed with a hood projecting from one end thereof and having an internal screw thread therein; and an adaptor comprising, an outer tubular metal shell formed at each end with an external screw thread meshing with a screw thread of a respective one of said connector parts, a dielectric sleeve frictionally secured in the shell in coaxial relationship therewith, a rectilinear electrical contact element frictionally retained in the bore of said sleeve, a shaft of said contact element projecting in opposite directions from said sleeve and said shell, and into the bore of the dielectric of each of said connector parts, and terminating in a mating portion positioned therein to mate with a mating electrical contact member inserted into said connector part from the other end thereof, each of said first and second connector parts constitutes, in combination with the adaptor, a shielded electrical jack, the dielectric of each of said parts defining a plug portion projecting in a direction away from the hood of said connector part, the bore of said dielectric extending through said plug portion, each mating portion of the electrical contact lying within the plug portion of the respective dielectric for mating with an electrical pin inserted into said plug portion.

15. A connector as claimed in claim 14, wherein said external screw threads are identical but are arranged in rotational symmetry.

16. A connector as claimed in claim 14, wherein said shell is provided with a circumferential, finger grip collar arranged between said external screw threads and projecting radially outwardly therebeyond.

17. A connector as claimed in claim 14, wherein said dielectric sleeve is in the form of a plug having a reduced cross section nose, said shield of the adaptor having an internally ribbed collar receiving said nose.

* * * * *